United States Patent [19]

Black

[11] 4,321,894

[45] Mar. 30, 1982

[54] POPPET VALVE SPRING RETAINER WITH INTEGRAL MECHANICAL ADJUSTABLE TAPPET

[76] Inventor: Alfred A. Black, 126 Beaver St., #108, Farmingham, Mass. 01701

[21] Appl. No.: 55,951

[22] Filed: Jul. 9, 1979

[51] Int. Cl.[3] ..... F01L 1/22

[52] U.S. Cl. ..... 123/90.54; 123/90.52; 123/90.67; 123/188 SC

[58] Field of Search ..... 123/90.45, 90.48, 90.52, 123/90.54, 90.65, 90.67, 90.28, 90.29, 188 S, 188 SB, 188 SC; 74/569

[56] References Cited

U.S. PATENT DOCUMENTS

| | | | |
|---|---|---|---|
| 1,857,005 | 5/1932 | Schotthoefer | 123/90.52 |
| 2,142,224 | 1/1939 | Turlay | 123/90.65 |
| 3,270,726 | 9/1966 | Cotton | 123/90.52 |
| 3,675,631 | 7/1972 | Hixson | 74/569 |
| 3,823,698 | 7/1974 | Van Deberg | 123/90.54 |

FOREIGN PATENT DOCUMENTS

| | | | |
|---|---|---|---|
| 496767 | 11/1919 | France | 123/90.52 |

*Primary Examiner*—Craig R. Feinberg
*Assistant Examiner*—W. R. Wolfe
*Attorney, Agent, or Firm*—William Nitkin

[57] ABSTRACT

A device for the adjustment of the gap between the valve stem and rocker arm or cam shaft of an internal combustion engine having a lower valve spring retainer base and upper cap member with adjustment means associated therewith.

7 Claims, 6 Drawing Figures

POPPET VALVE SPRING RETAINER WITH INTEGRAL MECHANICAL ADJUSTABLE TAPPET

BACKGROUND OF THE INVENTION

1. Field of the Invention

The device of this invention resides in the area of valve adjustment means for internal combustion engines having overhead cams or rocker arms and more particularly relates to a valve spring retainer including means for adjustment of the gap between the cam shaft and/or rocker arm and valve stem, and an hydraulic embodiment of same.

2. History of the Prior Art

In typical overhead cam engines the valves are operated by a rocker arm pushing on the valve stem or cam shaft pushing on bucket tappets. The rocker arm is usually actuated by a cam located in association therewith. In order to provide for the thermal expansion of the valve stem due to the heat created by the fuel combustion within the engine, gaps are usually provided between the valve stem and rocker arm. Most adjustments of the gap mentioned above are accomplished by means of locked screw or the use of shims placed within the bucket member positioned over the valve spring retainer. Although such adjustments are relatively simple, in many instances one must remove the cam shaft from the vehicle in order to place the shims in position under the bucket. In other systems the bucket may be adjusted by providing a screw member threaded across the top of the valve stem at an angle so that if it is rotated upward it raises the bucket or if it is rotated downward, it lowers the bucket. A gap adjustment device that is pertinent to the device of this invention is disclosed in U.S. Pat. No. 2,722,204, issued to Adolph Wente entitled "Means for Adjusting the Lost Motion of the Valve Actuation in Internal Combustion Engines." This system provides adjusting means that utilize a threaded valve stem on which a nut-like member is rotatably threaded. Systems such as this must provide means to prevent rotation of the valve stem when the nut is rotated thereon for adjustment.

SUMMARY

It is an object of this invention to provide a device for the adjustment of the gap between a valve stem and rocker arm which is substantially lighter in weight to that used in the present art, which is significantly less bulky, which replaces three to four elements now utilized to accomplish the same adjustment, and which removes the point of direct actuation of the valve stem from its top thereby lessening the stress on such stem and allowing it to be lighter in weight. It is a further object that the valve spring's resistance to compression not be transferred directly to the top of the valve stem as presently done in the prior art.

The device of the present invention is comprised of a valve spring retainer base which is adapted to fit over the valve spring and has an aperture through a central portion thereof for receipt of the valve stem, and lip means for the engagement of an outer and inner valve spring if such is used in the engine. The valve spring retainer base further has a central portion threaded on its inside and an upwardly extending outer portion threaded along its inside. The outer valve spring lip member located below the outer threaded portion of the valve spring retainer base projects downward to fit over, engage, and retain the outer valve's spring. At a position along the periphery of the upper portion of the outer section of the valve spring retainer base is a lock bolt receipt aperture whose function will be described below. A valve adjuster cap is also provided having on its bottom a central projection with threads upon the outer portion thereof adapted to be threadedly engaged into the inner threaded portion of the valve spring retainer base. The valve adjustor cap has along its outer periphery a threaded portion adapted to engage into the outer threaded portion of the valve spring retainer base. The top of the valve adjustor cap has a section thereon which is polygonal and, in a preferred embodiment, is hexagonal adapted to be engaged for the rotation by a wrench within the valve spring retainer base. A lock bolt is provided along with a cap lock member having an aperture therein through which the lock bolt may pass. The cap lock member has a lip member adapted to engage into a selected one of a plurality of apertures disposed around the periphery of the valve adjustor cap so that when the valve adjustor cap is rotated within the valve spring retainer base to its desired height for the adjustment of the gap between the valve stem and the rocker arm, it may be locked into position by the placement of the cap lock member with the lip or lips thereof engaged into the closest of the apertures within the valve adjustor cap. The lock bolt is then passed through the aperture within the cap lock member and passed into the lock bolt receipt aperture in the valve spring retainer base and is affixed into position by a nut threaded on its extending portion. Within the central portion of the projection centrally located on the underside of the valve adjustor cap is defined an area adapted for receipt of a valve stem spring member which fits therein and a valve stem bushing. The valve stem bushing has a projection upon one side thereof which engages the valve stem spring member. The valve stem bushing is adapted to fit into the valve stem bushing receipt area defined within the valve spring retainer base. The valve stem receipt aperture defined in the valve spring retainer base is constructed somewhat more narrowly at its base than at its top. When the valve stem is positioned therein, a valve ring clip is placed within a groove in the top of the valve stem which is then adapted to move freely in the top of the valve stem receipt aperture but not pass downward out of the valve stem receipt aperture due to the fact that the base of the valve stem receipt aperture is narrower than the valve ring clip positioned on the valve stem. When positioned on the valve stem, this clip retains the structure of this invention in place on top of the valve stem, and the valve spring is compressed keeping the valve in an upward position closing its associated port. When the top of the valve adjustor cap is struck by the cam directly or in some cases by the rocker arm, the valve's port will be opened. It has been found preferable to have the valve adjustor cap supported at both its center and its periphery rather than merely at one or the other position to prevent deformation at its center and to help distribute the force load more evenly over the top surface of the valve adjustor cap. It is expected that in the operation of this device, the valve stem will rotate to various positions during use which rotation assists in the distribution of any stress thereon. To prevent any difficulty in threading the valve adjustor cap into the valve spring retainer base due to unmatched threads between the inner and outer threads, one may in an additional embodiment have the valve adjustor cap constructed of two pieces, one being the outer threaded ring with a lip for the support of the outer portion of the inner cap. This outer threaded ring can have a plurality of projections extending from its top so that when the cap is threaded into the central thread of the valve adjustor base, these projections can be grasped by a tool and the outer threaded ring rotated to raise its lip to support the periphery of the valve cap. The valve adjustor cap may also have an insert aperture defined therein to receive a polygonal hardened steel insert if the valve cap and valve spring retainer base are to be constructed of aluminum or other light metal which might wear too easily from the action of the rocker arm or cam.

The spring-loaded bushing has been provided to help keep the valve in place when the device of this invention is depressed. It further assures that the valve stem will move downward at the same time or at an extremely short time after the device of this invention has started its downward movement. It still further allows for the possibility of expansion of the valve stem therein especially when the retainer adjustor is adjusted for a zero gap. Further, it helps eliminate a certain amount of the noise caused by the valve stem striking directly against the valve adjustor cap. It also keeps pressure on the valve stem even when the device of this invention is depressed to prevent or minimize any upward movement of the valve stem on its own as the depressing force of the valve cap is not focused directly upon the stem of the valve but is on the valve spring.

In some embodiments there may be provided one or more holes drilled within the valve spring retainer base that would allow oil to circulate within the chamber formed between the valve spring retainer base and the valve adjustor cap. The oil circulating through these holes will provide lubrication within the chamber and will also assist in decreasing noise by filling the relatively open chamber in which there might tend to be certain resonances. This embodiment will also assist in keeping the valve spring retainer base and valve adjustor cap cooler so that heat from cam shaft friction and heat transferred from the valve head through the valve stem to this invention would not cause significant expansion thereof.

Also disclosed herein is an embodiment of the valve adjustor base and cap member which can be utilized with hydraulic lifters. Since no adjustments are needed in hydraulic lifters as are needed in mechanical lifters, there are no threaded parts provided between the cap member and the valve spring retainer base. A chamber is provided within the cap member which, when positioned within the valve spring retainer base, is held in position by a semicircular clip which fits within a groove provided in the upper outer portion of the valve spring retainer base. An hydraulic piston is positioned above a valve stem bushing and has provided therebetween a preloaded spring and ball combination for the capture of hydraulic fluid therein upon the downward thrust of the cam or the rocker arm. The piston may be hollowed in its upper portion and have an aperture in its bottom aligned with the ball. The ball operates as an hydraulic valve for the piston, the piston being just above the ball, riding in the bore just above the pressure chamber. When the cap member is depressed, it moves the piston inward toward the center of its chamber, thereby compressing oil within the pressure chamber which action provides the means for transferring the movement of the cap member to the valve spring retainer base due to the minimal compressibility of the oil therein. Upon release of pressure on the device of this invention some oil will feed backwards out of the reservoir formed in the hollow of the piston and corresponding hollow in the cap member through the center hole of the piston. This flow is controlled by the ball which closes off the oil return under pressure while at times when there is no force thereupon, the hole allows oil to enter the reservoir above the ball. The design of the hydraulic embodiment of this invention has advantages over the current art which incorporates an hydraulic lifter within a separate housing bored into the top of the cylinder head. The hydraulic embodiment of this invention is held in position by the clip on the valve stem and the pressure of the valve spring upwards against the valve spring retainer base. This embodiment simplifies substantially the construction of hydraulic lifters and lessens significantly their weight. A valve stem bushing acts as a seal and prevents the escape of oil fluid from the pressure chamber down along the valve stem. In some embodiments the valve stem bushing can be threaded into its position to prevent its movement out of its seat or sealed in position by an O-ring or a pressed-in cup insert. In this embodiment holes can be provided within the valve spring retainer base in the midsection between its outer periphery and central section which would tend to lighten the structure and also allow oil to circulate therein which, as mentioned above, would lessen the noise from resonance and act as a reservoir of oil from which the pressure chamber would draw for its proper operation. It should be noted that in this embodiment there is an additional reservoir if the motor should run low on oil, oil would still be provided within the pressure chamber due to its being trapped between the valve spring retainer base and the cap member.

An alternate embodiment of the hydraulic version of this invention utilizes a hardened steel upper cap member with a lower cap member made of aluminum having a reservoir defined therein. Below the reservoir is a hardened steel cup member with an aperture defined therein. No bushing is used, but a second hardened steel cup member is placed in the valve spring retainer base and contains a hollow piston member. Within the upwardly facing hollow is the spring cap and ball which control entry of fluid from the reservoir.

DESCRIPTION OF THE PREFERRED EMBODIMENT(S)

Figure 1:
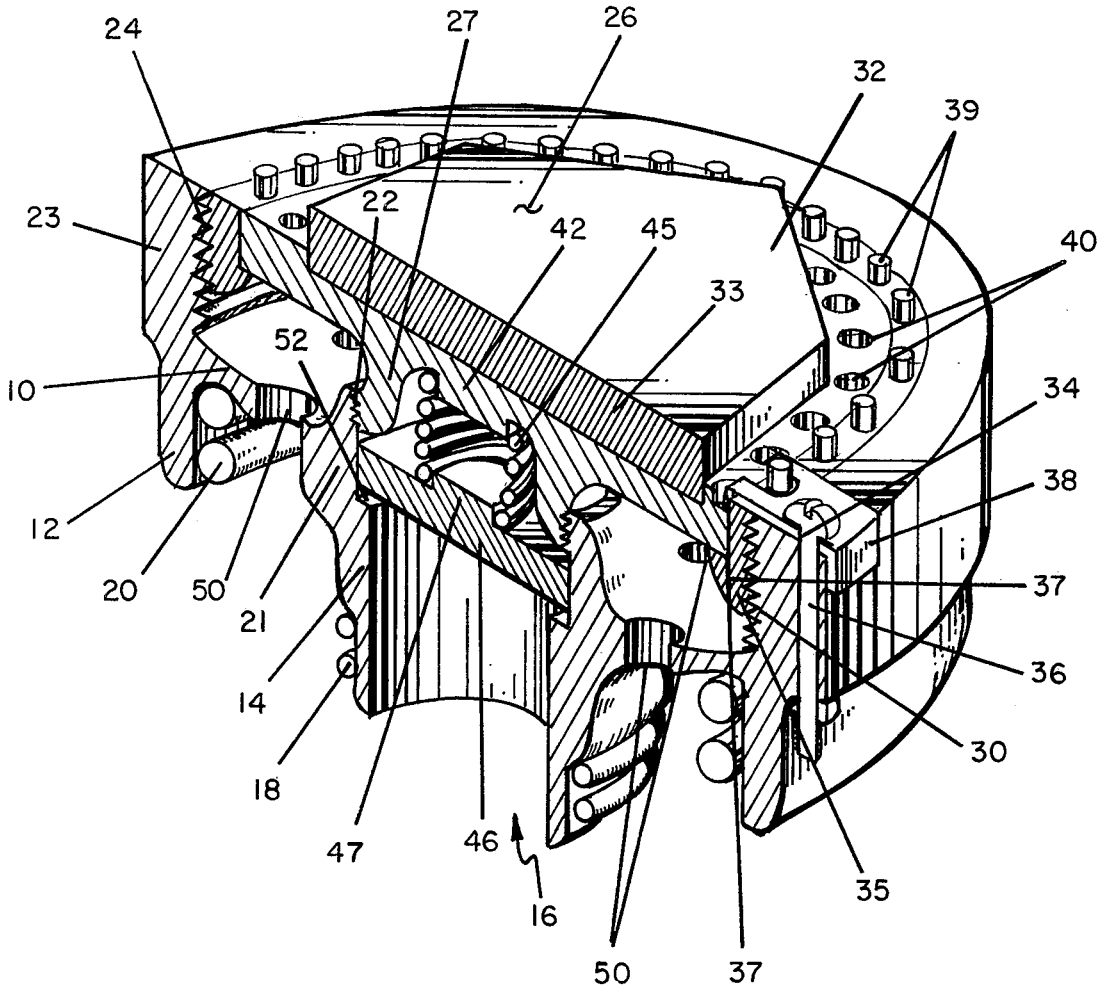
FIG. 1 is a perspective cross-sectional view of the device of this invention incorporating mechanical lifters.

In FIG. 1 valve spring retainer base 10 has on its bottom portions a protruding outer valve spring retaining lip 12 into which is engaged outer valve spring 20. Also seen in this view are inner valve spring lip 14 into which is engaged inner valve spring 18 and valve stem receipt aperture 16 into which the valve stem passes.

Aperture 16 is somewhat narrower at its base than at its top and acts to engage the valve stem due to a small clip inserted into a groove at the top of the valve stem. The valve stem is not shown in this illustration for the sake of clarity since such a valve stem and clip within a groove are well-known in the prior art and are used in the prior art to hold the valve spring cap in place thereon. Seen in a central portion of the valve spring retainer base 10 is valve stem bushing receipt ledge 52. Projection 21 is centrally positioned above the valve stem receipt aperture and has a threaded portion 22 along its insides. Valve spring retainer base 10 has an upwardly extending portion 23 along its periphery having along the inside thereof an inner threaded portion 24. Seen threaded into valve spring retainer base 10 is valve adjustor cap 26 which has positioned on its top a hexagonal member 32 for easy rotation thereof as mentioned below in relation to the hexagonal member 32. Such valve spring retainer base may be constructed as an insert into a cap receipt aperture 33. A portion of the valve adjustor cap 26 protrudes downward at a central portion, its threading 27 engaging central threaded portion 22 of the valve spring retainer base 10. The outer portions of the valve adjustor cap 30 can also be threaded to engage into and adjust in an upward and downward fashion as it is rotated within the valve spring retainer base 10. The valve adjustor cap can be constructed having a separate outer threaded ring portion 35 having a lip 37 adapted so that the valve adjustor cap may be supported by the lip around the cap's periphery. A plurality of adjustment projections 39 extend from threaded ring portion so that when the cap is centrally threaded, the threaded ring portion 35 can be backed up to it to support it by grasping and rotating such adjustment projections by a tool designed to engage them. Also seen in this view is lock bolt 36 passing through the cap lock member 38 and into the lock bolt receipt aperture 34 defined within the valve spring retainer base 10. The cap lock member is positioned within selected of the plurality of cap lock member holes 40 seen within the valve adjustor cap. A valve stem bushing 46 is provided and adapted to rest upon its ledge 52 within the valve spring retainer base, and a spring member 45 is provided to engage both a protruding portion of the valve stem bushing 47 and a projection 42 thereabove on the valve adjustor cap to keep pressure on the valve stem as described above. A plurality of apertures 50 may be provided within the valve spring retainer base and adjustor cap member to allow for the flow of oil therethrough.

Figure 2:
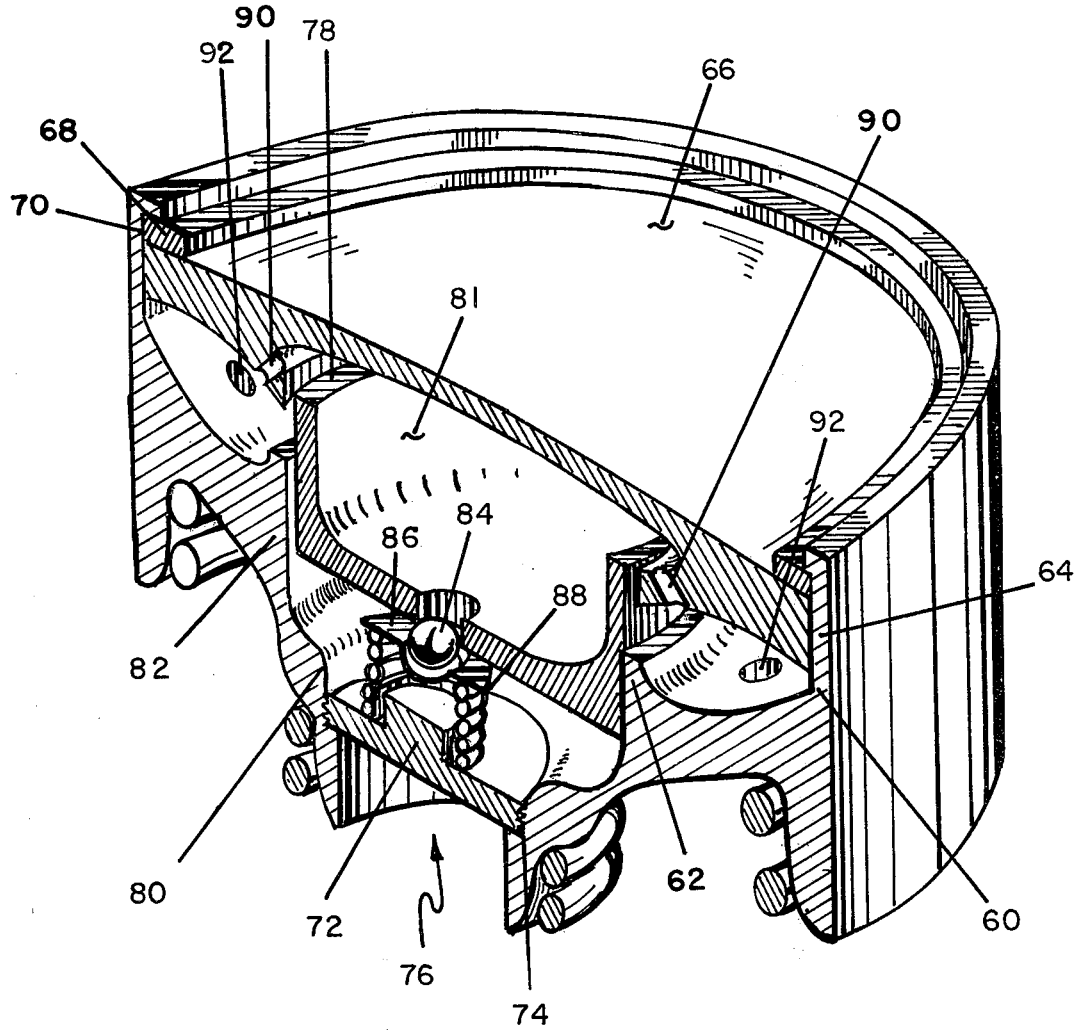
FIG. 2 is a perspective cross-sectional view of the device of this invention utilizing hydraulic lifters.

In the hydraulic embodiment of this invention as seen in FIG. 2 the valve spring retainer base 60 has a similar shape as the shape of the valve spring retainer base of the mechanical version except that central portion 62 and the outer portion 64 of the valve spring retainer base are not threaded. Retainer cap 66 is positioned within the valve spring retainer base and is held in place by retainer clip 68 which fits within groove 70 within the valve spring retainer base 60. In a first embodiment a valve stem bushing 72 is located on ledge 74 above the valve stem receipt aperture 76 above which is positioned piston 78 which rides within pressure chamber 80 formed by projections 82 extending from valve spring retainer base 60. Below the piston is located ball member 84 and plate 86 with spring member 88 positioned therebelow. At least one aperture 90 can be provided to allow for the entrance of oil into reservoir 81 for the hydraulic action as described above and one or more apertures 92 may be positioned within the valve spring retainer base 60 to allow for the entrance of oil therein.

Figure 3:
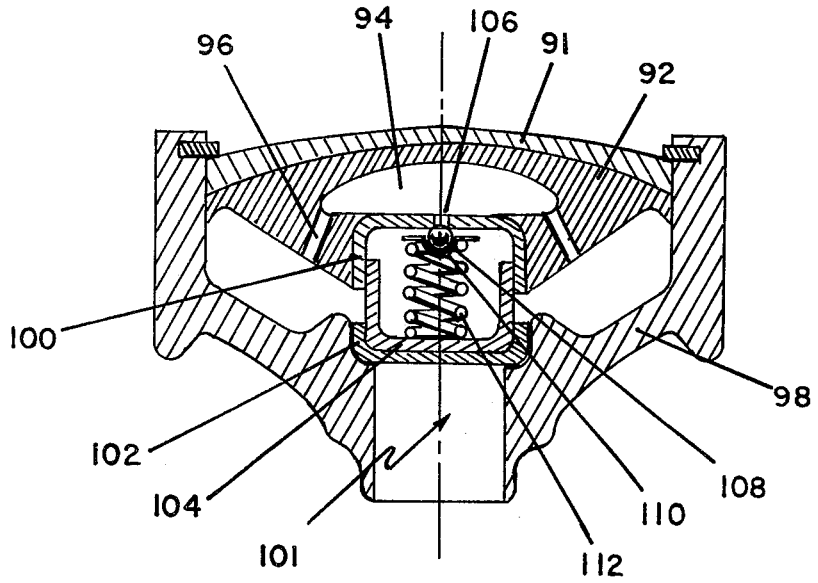
FIG. 3 is an alternate embodiment of the hydraulic version.

Illustrated in FIG. 3 is the second embodiment of the hydraulic version utilizing hardened cap 91 above lower cap 92 which has a reservoir 94 defined therein with oil entrance aperture 96 to allow oil into the reservoir. No bushing is used and this embodiment has an upper hardened steel cap 100 with an aperture defined therein positioned below the reservoir and a lower hardened steel cap 102 positioned above the valve stem receipt aperture 101. Within cap 102 is hollow piston 104. Within the upward facing hollow portion is ball 108 aligned with the aperture in the upper cap 100. Below ball 108 is cup 110 and spring 112 which extends to the inside hollow of piston 104.

Figure 4:
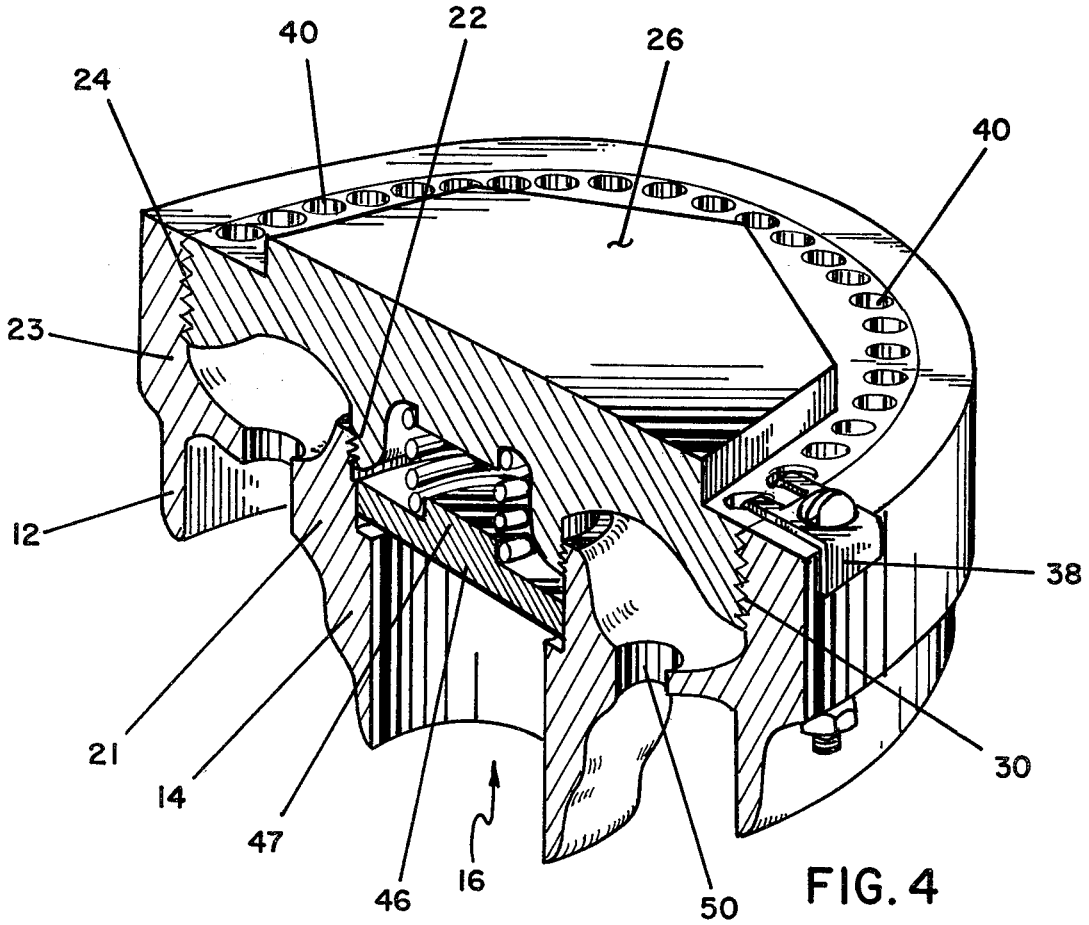
FIG. 4 is an embodiment having a solid cap.

FIG. 4 illustrates another alternate embodiment of the device of this invention having the cap member 200 constructed of a solid piece. It should be noted that the valve spring retainer base and bushing can be constructed of aluminum or other light weight metal and the cap member may be made of the same material or of a harder steel-like material as mentioned above to resist wear.

Figure 5:
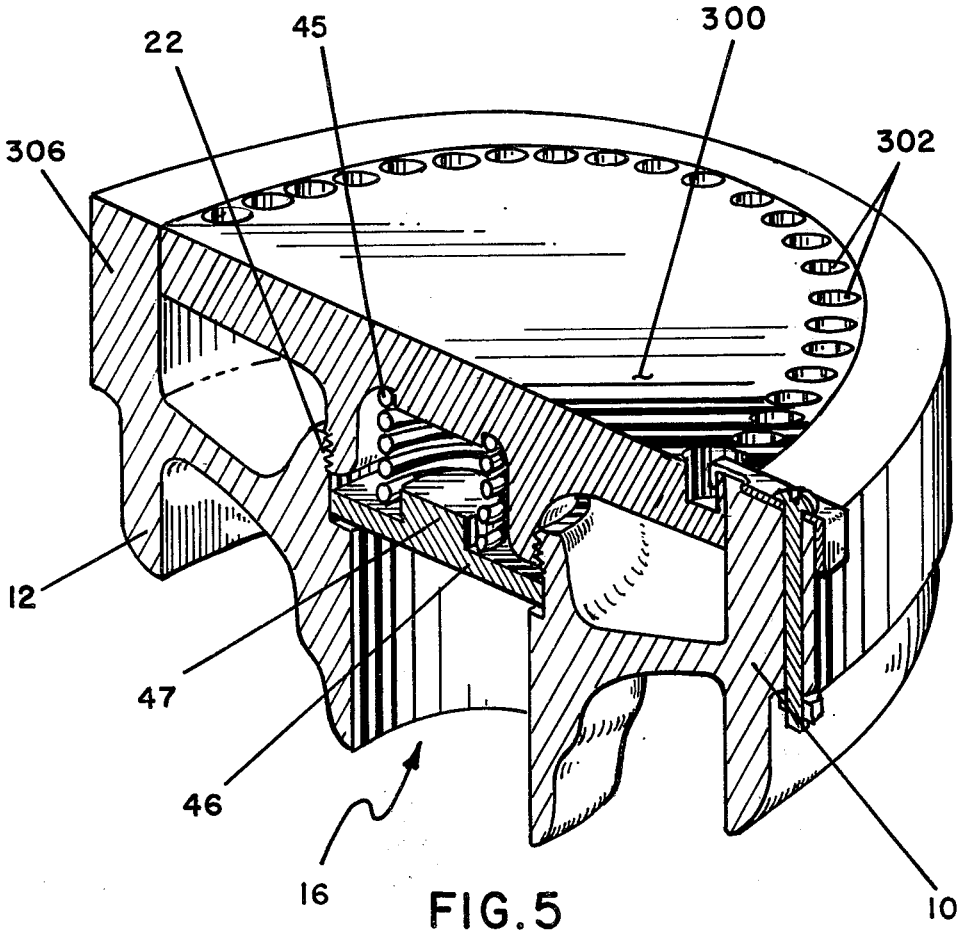
FIG. 5 is an embodiment having a round centrally threaded cap.

FIG. 5 illustrates a further alternate embodiment having a cap member with a round top 300 having apertures 302 defined therein for receipt of projections on a tool for the rotation thereof. In this embodiment only the central portion of the engagement between the cap and the valve spring retainer base 304 is threaded and there are no threads or other engagement means at the peripheral areas 306. This embodiment is useful in applications for example when using a rocker arm which strikes only the central portion of the cap member.

Figure 6:
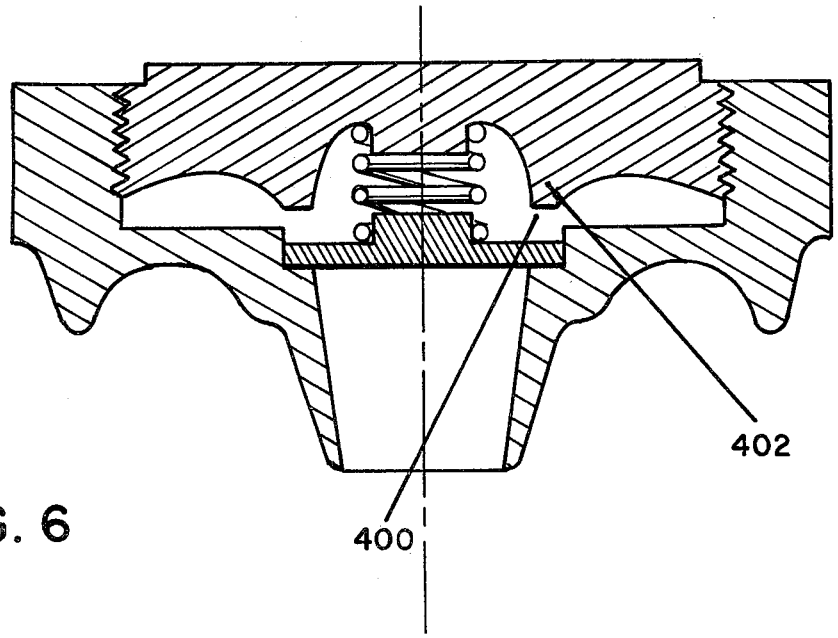
FIG. 6 is an embodiment having a peripherally threaded cap.

FIG. 6 illustrates yet still another embodiment having the cap member only peripherally threaded. This embodiment is especially useful for smaller retainer members such as are used in motorcycles and other small motors.

It should be noted that there are many advantages to the utilization of adjustable valve spring retainers of this invention besides their being compact and lighter in weight than the structures that accomplish similar functions in the prior art. One advantage is that the valve spring retainer cap can be set at a smaller gap or at a zero lash than is now possible with present gap-adjusting devices without the significant problem of the valve head being forced into the valve chamber upon the thermal expansion of the valve stem. The gap above the bushing allows the stem to expand therein by upward movement thereof. Since the bushing in the mechanical embodiment herein is not retained rigidly in place, it can allow the valve stem to move somewhat into the valve stem retainer of this invention. This movement would also allow combustion chamber pressure to assist in closing the valve where such pressure would push the valve upwards only against the weaker pressure of the valve bushing spring which would seal the combustion chamber. In the situation where the bushing is constructed of a soft material and the bore in which it rests is of the same dimensions as the valve stem receipt aperture, the valve stem retainer of this invention will advantageously provide a place of movement by its deformation when struck by the valve stem in situations where the engine is overrevved and the valve head is hit by the piston. This destruction or deformation of the bushing dissipates the destructive force, minimizing damage to the valve so that repairs may be made easily to the device of this invention without having to pull the head off the engine to reach a damaged valve.

Although the present invention has been described with reference to particular embodiments, it will be apparent to those skilled in the art that variations and modifications can be substituted therefor without departing from the principles and spirit of the invention.

I claim:

1. A device for gap adjustment between a valve stem and its operation means within an internal combustion motor comprising:

a valve spring retainer member adapted to be retained upon said valve stem;

a first adjustment means incorporated into said valve spring retainer member for adjustment of said gap;

a lower valve spring retainer member having a valve stem receipt aperture defined therein;

a cap member;

means for adjustment of said cap member in relation to said valve spring retainer member for adjustment of said gap; and a second adjustment means disposed above said valve stem receipt aperture for adjusting the gap between the top of said valve stem and said cap member and limiting the protrusion of said valve stem into said valve stem receipt aperture while allowing for the thermal expansion and reciprocating movement of said valve stem.

2. The device of claim 1 wherein said valve spring retainer member and said second adjustment means further includes:

a first lip means enclosing and retaining the upper coils of the valve spring;

a second lip means incorporated into said valve spring retainer for retention of an inner valve spring member;

an outer upwardly extended inside threaded portion incorporated in said valve spring retainer;

a central upwardly extended inside threaded portion incorporated in said valve spring retainer, the inner portion of which defines a bushing ledge;

a bushing member having a central projection defined on an upper side, said bushing being positioned on said bushing ledge;

a lock bolt receipt aperture defined within the periphery of said upwardly extending portion of said valve spring retainer base;

a valve adjustor cap including means for engagement of said valve spring retainer base, said means adapted to allow the upward and downward adjustment of said valve adjustor cap within said valve spring retainer base; and a spring member positioned between said valve bushing and said valve adjustor cap.

3. The device of claim 2 wherein said valve adjustor cap includes a threaded outer portion and a threaded central projection, both adapted to engage the threaded portions of said valve spring retainer member.

4. The device of claim 2 wherein said valve adjustor cap is comprised of an outer threaded ring member adapted to threadedly engage the outer threaded portion of said valve spring retainer member having a lip around its inside circumference and a cap member having an inner threaded portion adapted to engage the central threaded portion of the valve spring retainer member, and whose outer periphery is adapted to rest upon said outer threaded ring member's inner lip and means to rotate said outer threaded ring independently of said valve adjustor cap.

5. The device of claims 2, 3, or 4 further including a plurality of apertures defined within the outer periphery of the top surface of said valve adjustor cap and locking means adapted to engage into selected of said apertures to lock said valve cap into position to prevent rotation of same within said valve spring retainer member.

6. The device of claims 2, 3, or 4 wherein is located within a central portion of said valve adjustor cap a polygonal projection for ease in rotating said valve adjustor cap within said valve spring retainer member.

7. The device of claim 6 wherein said polygonal projection is an insertable member within an aperture defined within said valve adjustor cap.

* * * * *

UNITED STATES PATENT AND TRADEMARK OFFICE

CERTIFICATE OF CORRECTION

PATENT NO. : 4,321,894
DATED : March 30, 1982
INVENTOR(S) : Alfred A. Black

It is certified that error appears in the above-identified patent and that said Letters Patent are hereby corrected as shown below:

| | |
|---|---|
| Column 2, line 44 | delete "ring clip" and substitute therefor --keeper key--. |
| Column 2, line 50 | delete "ring clip" and substitute therefor --keeper key--. |
| Column 2, line 51 | delete "clip" and substitute therefor --keeper key--. |
| Column 3, line 13 | delete "metal" and substitute therefor --material--. |
| Column 4, line 14 | delete "clip" and substitute therefor --keeper key--. |
| Column 4, line 38 | delete "aluminum" and substitute therefor --lightweight material--. |
| Column 5, line 19 | delete "valve spring retainer base". |
| Column 6, line 21 | delete "metal" and substitute therefor --material--. |
| Column 6, line 61 | delete "in which" and "rests" and add --above it-- after the word "bore". |

Signed and Sealed this

*Twenty-sixth* Day of *October 1982*

[SEAL]

*Attest:*

GERALD J. MOSSINGHOFF

*Attesting Officer*

*Commissioner of Patents and Trademarks*